United States Patent [19]

Rae, Jr.

[11] 4,317,465

[45] Mar. 2, 1982

[54] COMB WITH INTEGRAL CLIP FOR ATTACHING TO A SUPPORT

[76] Inventor: Thomas A. Rae, Jr., 14144 E. Seven Mile, Detroit, Mich. 48205

[21] Appl. No.: 220,769

[22] Filed: Dec. 29, 1980

Related U.S. Application Data

[63] Continuation of Ser. No. 924,941, Jul. 17, 1978, abandoned, which is a continuation of Ser. No. 723,034, Sep. 13, 1976, abandoned.

[51] Int. Cl.[3] ..... A45D 24/00

[52] U.S. Cl. ..... 132/149

[58] Field of Search ..... 132/11 R, 101, 124, 132/144, 149, 150; D28/32, 29, 30.1, 34; 15/257.2; 252/64; 46/17, 23, 29

[56] References Cited

U.S. PATENT DOCUMENTS

| | | | |
|---|---|---|---|
| 2,199,282 | 4/1940 | Condron et al. | 132/149 |
| 2,411,252 | 11/1946 | Finman | 132/149 |
| 2,467,975 | 4/1949 | Hollen | 132/149 |

*Primary Examiner*—G. E. McNeill

*Attorney, Agent, or Firm*—Hauke and Patalidis

[57] ABSTRACT

A comb adapted for attaching to a support member, such as the bracket of a motor car inside rear-view mirror, is provided with an integral handle having an extending end terminating in a resilient clamp arrangement which enables the comb to be conveniently attached to, and removed from, a support member which is dimensioned to receive the clip jaws.

4 Claims, 4 Drawing Figures

FIG. 1
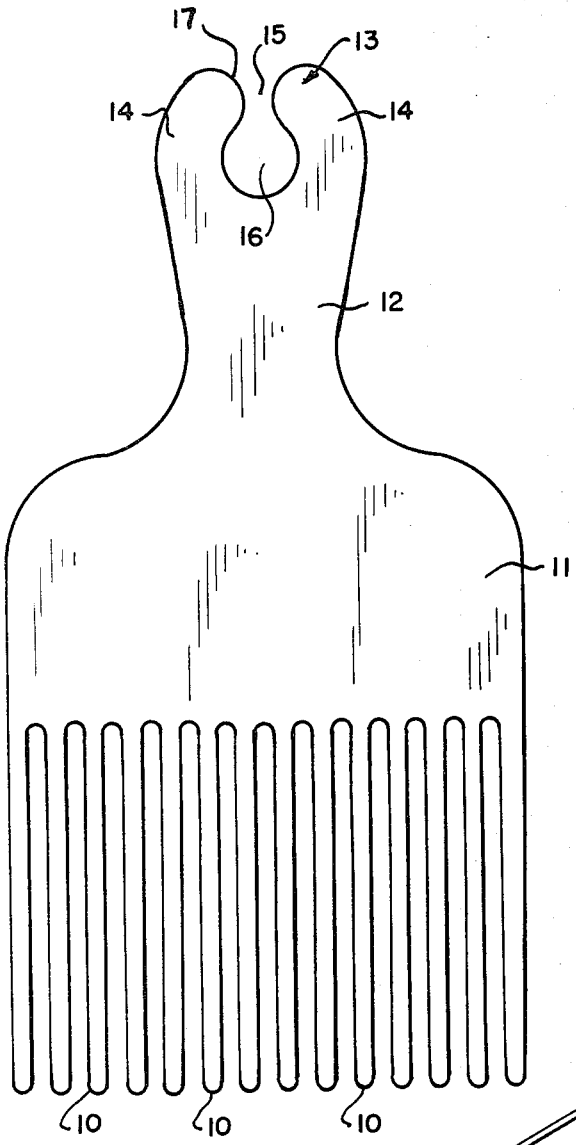
FIG. 2
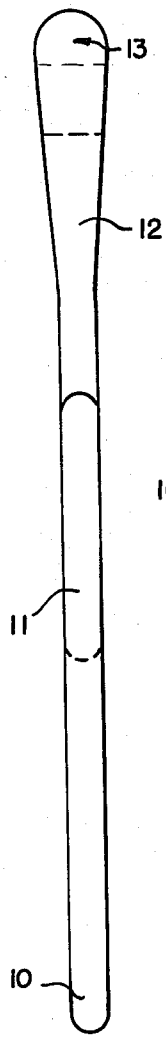
FIG. 3
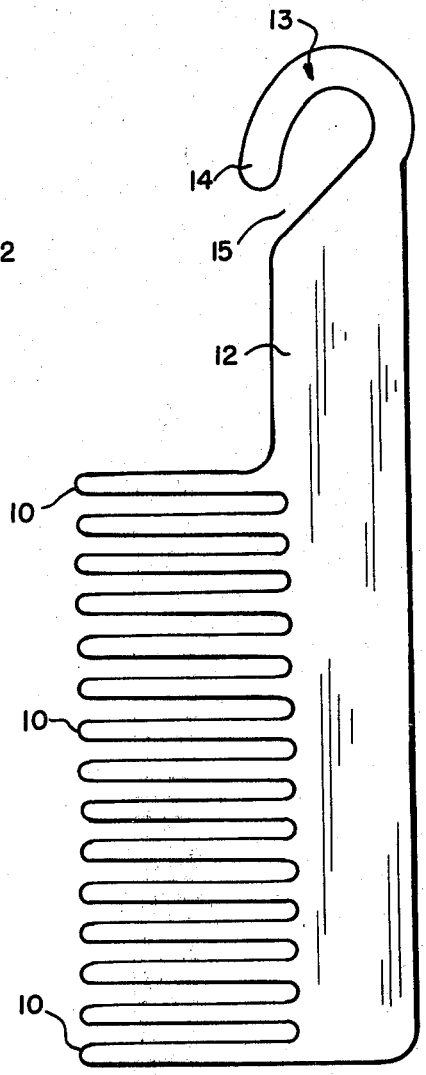
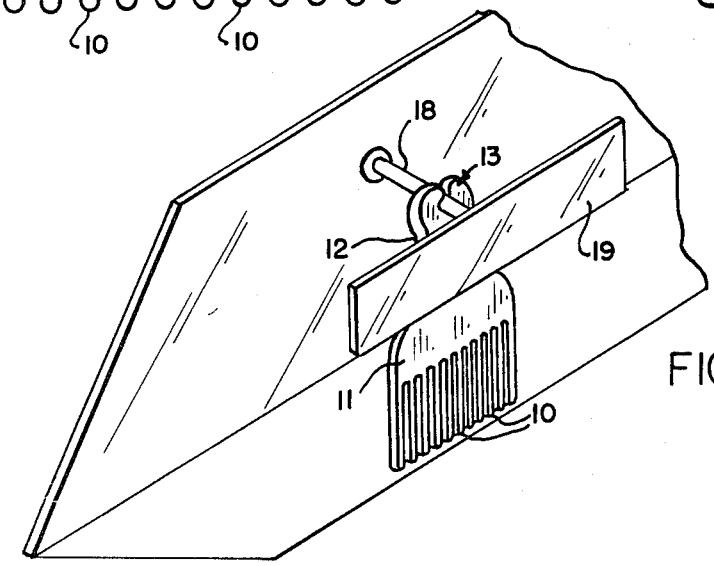
FIG. 4

COMB WITH INTEGRAL CLIP FOR ATTACHING TO A SUPPORT

This application is a continuation of application Ser. No. 924,941, filed July 17, 1978, which was a continuation of application Ser. No. 723,034, filed Sept. 13, 1976, both now abandoned.

BACKGROUND OF THE INVENTION

For many centuries the dressing of women's hair has required a great deal of attention and in recent years the dressing of men's hair has demanded increasing attention. Hair, once arranged, can be rather quickly disarranged when exposed to the wind and, therefore, constant resort to a comb is required to restore a hair arrangement to the perfection previously achieved before a mirror. This is particularly the case with respect to certain hair-dos, such as the currently popular "Afro" hair-do, and under particular conditions such as riding in a motor car with open windows. Consequently, it is desirable to have a comb conveniently located in a motor car. The present invention is aimed at providing a comb which can be quickly and easily placed in a convenient accessible location in a motor car when the comb is not in use.

SUMMARY OF THE INVENTION

The present invention contemplates providing a comb with an integral handle made of slightly resilient material, preferably a resilient polymeric material. The handle has an extending end which terminates in a resilient clip portion which may be integrally formed with the handle so that it is composed of the same material as the handle. The clip has a restricted open mouth which leads to an enlarged support surrounding area. The clip, integral with the comb handle, is used to attach the comb on a support member such as the bracket of a motor car inside rear-view mirror. The mouth of the clip is slightly smaller than the support member on which it is to be mounted, and the enlarged area is preferably slightly larger than the member. Thus, the comb may be quickly attached to, or removed from, the support member.

BRIEF DESCRIPTION OF THE DRAWING

FIG. 1 is a plan elevation view of an example of comb made in accordance with the invention;

FIG. 2 is a side view of the comb illustrated at FIG. 1;

FIG. 3 is a view similar to FIG. 1, but showing a modification thereof; and FIG. 4 is a schematic representation of the comb of the invention attached to the rear-view mirror bracket of a motor vehicle.

DETAILED DESCRIPTION OF THE PREFERRED EMBODIMENTS

Referring particularly to FIG. 1, a comb according to the present invention consists of a plurality of spaced and aligned teeth 10 which integrally extend outwardly from a support trunk or stem 11. The trunk 11 is integral with a handle 12 which is included for ease of handling and manipulation. The end of the handle 12 terminates in a clip arrangement 13. As shown at FIG. 2, the handle 12 and clip 13 may be formed as to be provided with a slight progressive taper to improve strength and make gripping easier.

In the embodiment of FIG. 1, the clip 13 is bifurcated and consists of a pair of arms or jaws 14 which are symmetrically positioned and spaced slightly to provide an open mouth indicated at 15. The mouth 15 defines a restricted passage leading to an enlarged support surrounding area 16 defining the space between the arms or jaws 14. The clip mouth 15 and the enlarged support surrounding area 16 are dimensioned with respect to a support member (not shown) on which the comb is to be attached so that the distance across the mouth 15 is slightly less than the thickness of the support and the distance across the enlarged area 16 is preferably slightly greater than the thickness of the support. Thus, when it is desired to attach the comb on a support member, such as the support bracket 18 of a motor car inside rear-view mirror 19, (FIG. 3), all that is required is to manually apply pressure on the comb, with the clip mouth 15 engaged against the support member such as to spread the arms 14 slightly apart due to the resilience of the polymeric material. Once the bracket is disposed in the open space or area 16, the arms 14 spring back to their original position, thus holding the comb attached to the support. With proper dimensions of the clip mouth 15 and of the open area 16 the comb is held firmly in place and will not readily jar loose. The ends of the arms 14 forming the clip mouth 15 are preferably tapered or rounded, as shown at 17 to facilitate insertion over the support member. Removal of the comb from the support member involves the simple act of grasping and pulling the comb with sufficient force to dislodge it from the support member.

The embodiment of FIG. 3 operates in the same manner as the embodiment of FIGS. 1 and 2 but the clip is of a slightly different configuration. In this embodiment, the clip 13 terminates in a single arm 14 which, together with an edge of the handle 12, defines the clip open mouth 15. The clip mouth 15 leads to an enlarged area 16 having the same function as the embodiment of FIG. 1. In the FIG. 3 embodiment, almost the entire opening movement of the mouth 15 must be accomplished by the single arm 14 and therefore there is greater stress on the arm 14 than in the case of the FIG. 1 embodiment. However, the FIG. 3 embodiment presents the advantage that the hook shape of the clip 13 enables the comb to be hung from a very small support member which can be smaller in thickness than the distance across the mouth 15 of the clip.

While the comb of the invention may be made of metallic material it is particularly adapted to be formed of molded polymeric material. Such materials as hard rubber, nylon, polyester, polyacrilics, ABS, and others are entirely satisfactory. While the article may be made in several parts, it is preferable from a cost point of view that it be made as a one-piece molded structure.

Preferably, at least part of the comb of the invention is made of, or is coated with, a phosphorescent or luminescent material such that the comb may be easily located in the dark.

While the invention has been described with regard to certain specific embodiments, it is obvious that there may be variations which properly fall within the scope of the invention. Accordingly, the invention should be limited in scope only as may be necessitated by the scope of the appended claims.

What is claimed as new is as follows:

1. In combination, a cylindrical support member and a comb consisting of a single piece substantially flat molding of resilient polymeric material provided with a plurality of evenly spaced straight parallel teeth of equal length integrally projecting from a trunk portion integrally terminating in an elongated handle, said handle having an extending end formed as an integral clip removably attachable to said cylindrical support member, said clip comprising an open area accepting said support member and a restricted passage leading to said open area, said restricted passage and said open area being formed between two opposed integral portions of said handle, at least one of which is resiliently spreadable from the other for allowing said support member to be passed through said restricted passage to said open area for holding said comb in a storage position suspended from said support member, said resiliently spreadable portion being in the form of an arm having a rounded free end normally converging toward and disposed proximate said other portion forming said restricted passage with a progressively decreasing width causing resilient spreading of said spreadable portion from said other portion when said support member is passed through said restricted passage from the outside of said clip to said open area, and said resiliently spreadable portion in the form of an arm having a side within said open area progressively converging toward said restricted passage forming a progressively decreasing width for said passageway causing resilient spreading of said spreadable portion allowing said support member to pass through said restricted passage from said open area to the outside of said clip for removing said comb from said support member, wherein said teeth, said trunk, said handle and said clip are integrally formed in one piece substantially in a single flat plane, wherein said support member is disposed substantially transverse to said plane when said comb is suspended from said support member with said support member positioned in said open area in said clip and wherein said support member is a motor car interior rear-view mirror support bracket.

2. The comb of claim 1 wherein said clip is in the form of a pair of bifurcated arms integrally disposed at the end of said handle, said arms being symmetrically disposed and each having an end disposed proximate the end of the other arm.

3. The comb of claim 1 wherein at least a portion of said comb is provided with a phosphorescent or luminescent surface.

4. The comb of claim 1 wherein said handle has a progressively increasing thickness toward the end thereof.

* * * * *